US007216597B2

(12) United States Patent
Shiraishi

(10) Patent No.: US 7,216,597 B2
(45) Date of Patent: May 15, 2007

(54) THREADING DEVICE FOR SEWING MACHINE

(75) Inventor: Atsushi Shiraishi, Chofu (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 11/442,184

(22) Filed: May 26, 2006

(65) Prior Publication Data

US 2006/0278146 A1 Dec. 14, 2006

(30) Foreign Application Priority Data

May 30, 2005 (JP) ..... 2005-156928

(51) Int. Cl.
*D05B 87/02* (2006.01)
*D05B 55/14* (2006.01)

(52) U.S. Cl. ..... 112/225

(58) Field of Classification Search ..... 112/220, 112/221, 224, 225; 223/99
See application file for complete search history.

(56) References Cited

U.S. PATENT DOCUMENTS 2,910,029 A * 10/1959 Herbst ..... 112/225
5,072,678 A * 12/1991 Satoma ..... 112/225
5,195,452 A * 3/1993 Kamiya ..... 112/225
6,067,919 A * 5/2000 Shoji ..... 112/225
6,564,731 B2 * 5/2003 Sano et al. ..... 112/225

FOREIGN PATENT DOCUMENTS

JP 4-64386 2/1992
JP 10-137481 5/1998

* cited by examiner

*Primary Examiner*—Ismael Izaguirre
(74) *Attorney, Agent, or Firm*—Merchant & Gould P.C.

(57) ABSTRACT

A threading device for a sewing machine includes a needle bar provided with a guide member having a stopper portion, a threading shaft having a threading member, operation means having a guide groove formed in a spiral shape with respect to a rotating axis of the threading shaft, and a pin, which is fixed to the threading shaft, having both ends protruded outward in a radial direction with respect to the threading shaft. One end of the pin penetrates the guide groove while the other end of the pin engages with the stopper portion. The threading device further includes erroneous rotation preventing means which prevents the threading shaft from rotating in when the threading shaft moves downward, and permits the threading shaft to rotate when the second end of the pin engages with the stopper portion.

4 Claims, 12 Drawing Sheets

THREADING DEVICE FOR SEWING MACHINE

The present invention claims foreign priority to Japanese patent application no. 2005-156928, filed on May 30, 2005, the content of which is incorporated herein by reference.

1. Field of the Invention

The present invention relates to a threading device for a sewing machine for inserting a thread through a needle eye of a needle.

2. Description of the Related Art

Conventionally, there has been known a threading device for inserting a needle thread through a needle eye of a needle of a sewing machine. For example, a needle thread cut to have a predetermined length is pulled in by means of a fine threading hook capable of passing through the needle eye of the needle of the sewing machine so that the thread can be inserted (for example, see JP-A-10-137481 and JP-A-4-64386).

For example, as shown in FIGS. 11A and 11B, a threading hook 308 is provided on a tip of a threading shaft 302 disposed in almost parallel in the vicinity of a needle bar 301 and a pin 303 is provided to penetrate through an upper end of the threading shaft 302 so as to be almost perpendicular to an axial direction. Moreover, a threading lever 304 for operating a vertical motion of the threading shaft 302 is coupled to the threading shaft 302 by inserting the pin 303 into a guide groove 305 formed on the threading lever 304. Furthermore, a shaft spring 306 is provided between the pin 303 and the threading lever 304, and the threading shaft 302 can be moved interlockingly with the threading lever 304 by the energizing force of the shaft spring 306.

When the threading operation is to be carried out, the threading lever 304 is pushed downward in the state of FIGS. 11A and 11B so that the threading shaft 302 is also pushed downward at the same time as shown in FIGS. 12A and 12B. On the other hand, the pin 303 of the threading shaft 302 collides with a needle bar guide 307 attached to the needle eye in a certain position so that the downward movement of the threading shaft 302 is stopped. However, the threading lever 304 can be moved further downward with respect to the threading shaft 302. As shown in FIGS. 13A and 13B, therefore, the threading shaft 302 is rotated through the pin 303 inserted in the guide groove 305 by the action of the guide groove 305. With the rotation of the threading shaft 302, the thread is inserted through the needle eye by means of the threading hook 308 provided on the tip of the threading shaft 302.

In respect of a structure of the conventional threading device, however, in some cases in which the threading lever 304 is operated while it is strongly pushed toward the needle bar 301 side or the threading lever 304 is pushed downward at a high speed, the downward movement of the threading shaft 302 is stopped by a friction of the threading shaft 302 and a bearing 309 for supporting the threading shaft 302 movably in a vertical direction. On the other hand, the downward movement of the threading lever 304 is not stopped. By the downward movement of the threading lever 304, therefore, the threading shaft 302 is rotated through the pin 303 of the threading shaft 302. In some cases, consequently, the threading hook 308 starts a rotation in a position other than a normal position and the threading hook 308 is caused to enter the needle eye to pull in the thread, that is, the thread cannot be inserted through the needle eye. In some cases, moreover, the threading hook 308 is rotated in the position other than the normal position so that the threading hook 308 is bent.

As a method of preventing the erroneous rotation of the threading hook 308, therefore, a guide (not shown) for extending the pin 303 provided on the threading shaft 302 and guiding the pin 303 corresponding to a stroke of the threading shaft 302 is provided to prevent the erroneous rotation. However, a great deal of space is occupied, and furthermore, the guide cannot be provided in a section in which the threading operation can be carried out. In the section, the erroneous rotation is caused in some cases.

SUMMARY OF THE INVENTION

It is an object of the present invention to provide a threading device for a sewing machine which can prevent the erroneous rotation of a threading hook in all sections even if a threading lever is operated in a severe condition.

However, the present invention need not achieve the above object, and other objects not described herein may also be achieved. Further, the invention may achieve no disclosed objects without affecting the scope of the invention.

According to a first aspect of the invention, it is preferable that a threading device for a sewing machine include a threading shaft disposed in parallel with a needle bar having a needle provided at a lower end thereof, and supported rotatably and movably in a vertical direction with respect to a machine frame, a threading member provided at a lower end of the threading shaft, and having a threading hook capable of being inserted through a needle eye of the needle, a pin fixed to the threading shaft, and having both ends protruded outward in a radial direction with respect to the threading shaft, operation means having a guide groove formed in a spiral shape with respect to a rotating axis of the threading shaft, and capable of being operated in a vertical direction, one end of the pin being inserted through the guide groove, a guide member having a stopper portion disposed on a vertical moving path of the other end of the pin, and a clearance groove formed seamlessly with respect to the stopper portion, and fixed to the needle bar, and an erroneous rotation preventing member having a disengaging portion capable of being engaged with the stopper portion and a rotation regulating portion capable of being engaged with the pin, and provided on the threading shaft. The other end of the pin engages with the stopper portion when the threading shaft moves downward by operating the operation means to move downward, and the threading shaft rotates along the guide groove so that the threading member penetrates through the needle eye of the needle when the threading shaft further moves downward. Further, the disengaging portion engages with the stopper portion before the other end of the pin engages with the stopper portion in the downward movement of the threading shaft, and the rotation regulating portion engages with the pin to prevent the rotation of the threading shaft until at least the threading shaft further moves downward after the disengaging portion engages with the stopper portion.

According to a second aspect of the invention, as set forth in the first aspect of the invention, it is preferable that the rotation regulating portion has a side surface disposed opposite to the other end of the pin on a side where the threading shaft rotates along the guide groove, and the disengaging portion is protruded downward by at least a vertical length of the pin from a lower end the side surface of the rotation regulating portion.

According to a third aspect of the invention, as set forth in the first aspect of the invention, it is preferable that the erroneous rotation preventing member includes a pair of projections to be engaged with the operation means so as not to be rotated with respect to the operation means.

According to a fourth aspect of the invention, it is preferable that a threading device for a sewing machine include a threading shaft disposed in parallel with a needle bar having a needle provided at a lower end thereof, and supported rotatably and movably in a vertical direction with respect to a machine frame, a threading member provided at a lower end of the threading shaft, and having a threading hook capable of being inserted through a needle eye of the needle, a pin fixed to the threading shaft, and having both ends protruded outward in a radial direction with respect to the threading shaft, operation means having a guide groove formed in a spiral shape with respect to a rotating axis of the threading shaft, and supporting the threading shaft rotatably and movably in a vertical direction, a guide member having a stopper portion disposed on a vertical moving path of the other end of the pin, and a clearance groove formed seamlessly with respect to the stopper portion, and fixed to the needle bar, and erroneous rotation preventing means. The other end of the pin engages with the stopper portion when the threading shaft moves downward by operating the operation means to move downward, and the threading shaft rotates along the guide groove so that the threading member penetrates through the needle eye of the needle when the threading shaft further moves downward. Further the erroneous rotation preventing means prevents the threading shaft from rotating in the downward movement of the threading shaft, and permits the threading shaft to rotate when the other end of the pin engages with the stopper portion.

According to the present invention, in a threading device for a sewing machine, even if operation means is operated in a severe condition, it is possible to prevent an erroneous rotation in all sections of a threading shaft in a small space.

DESCRIPTION OF THE EXEMPLARY EMBODIMENT

An embodiment of the invention will be described below with reference to the drawings.

Figure 1:
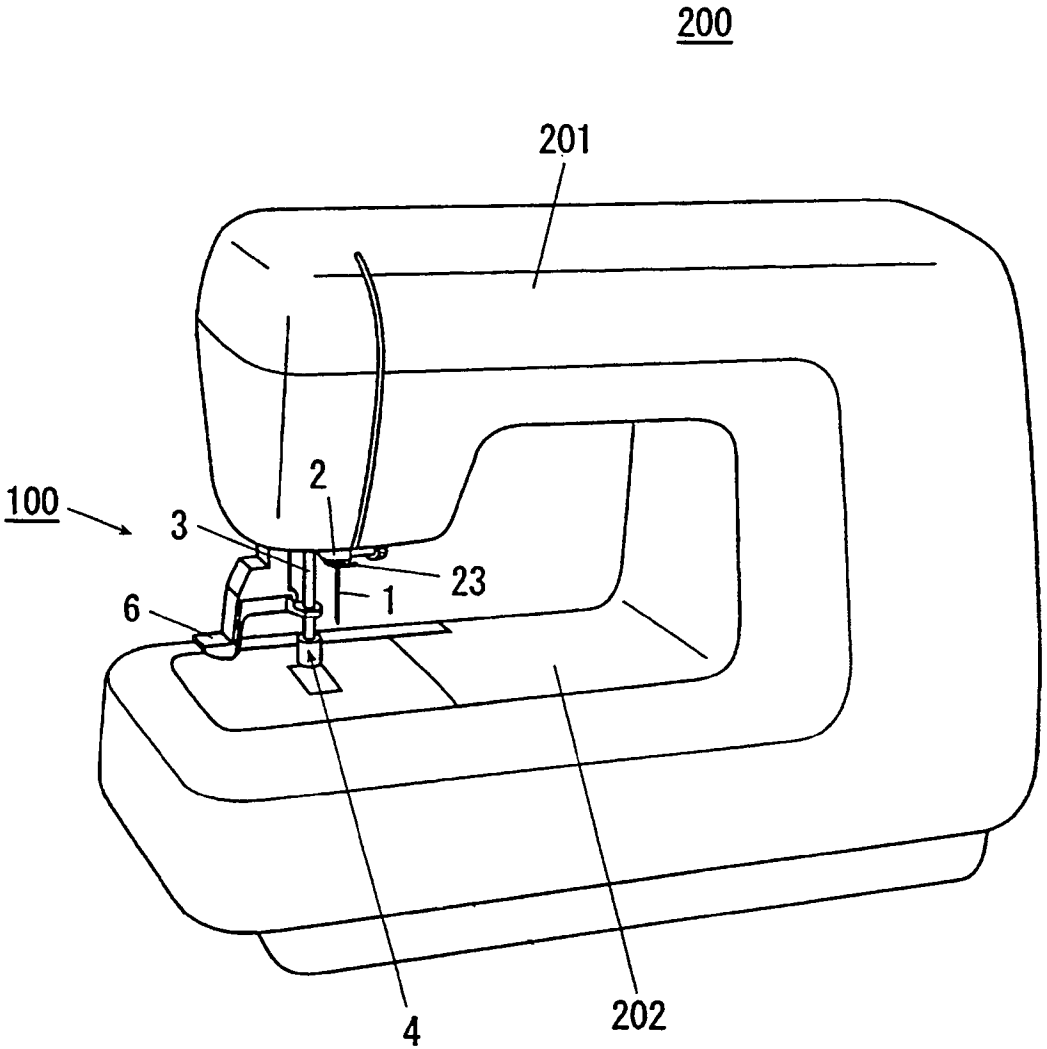
FIG. 1 is a perspective view showing a sewing machine to which a threading device for a sewing machine according to an embodiment of the invention is attached.

FIG. 1 is a perspective view showing a sewing machine 200 to which a threading device according to an embodiment of the invention is attached.

The sewing machine 200 is constituted by a bed portion 202 having an upper surface to be a sewing work table, and an arm portion 201 which is integrally extended upward and leftward from a right end of the bed portion 202. A needle bar 2 including a needle 1 on a lower end is provided in a tip part of the arm portion 201, and a cloth feeding mechanism and a horizontal rotary hook mechanism which are not shown are provided in the bed portion 202 corresponding to the needle 1. Moreover, a motor and a power transmitting mechanism which are not shown but serve as driving sources are provided in the bed portion 202, and the power of the motor is transmitted to the needle bar, the cloth feeding mechanism and the horizontal rotary hook mechanism, thereby carrying out each sewing operation.

Moreover, a thread frame (not shown) is set to an upper part of the arm portion 201. A thread supplied from the thread frame is guided to the needle 1 through a thread tensioner (not shown) and a thread take-up (not shown) which are provided in the arm portion 201, and is inserted through a needle eye (not shown) of the needle 1.

A threading device 100 according to the invention is attached to the tip part of the arm portion 201. In FIG. 1, a threading hook is omitted because of the drawings.

Figure 2B:
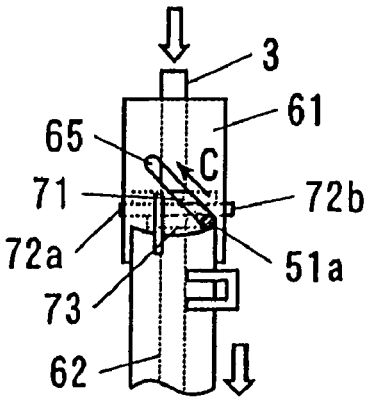
FIG. 2B is a left side view showing an upper end of the threading device for a sewing machine illustrated in FIG. 2A.
Figure 2A:
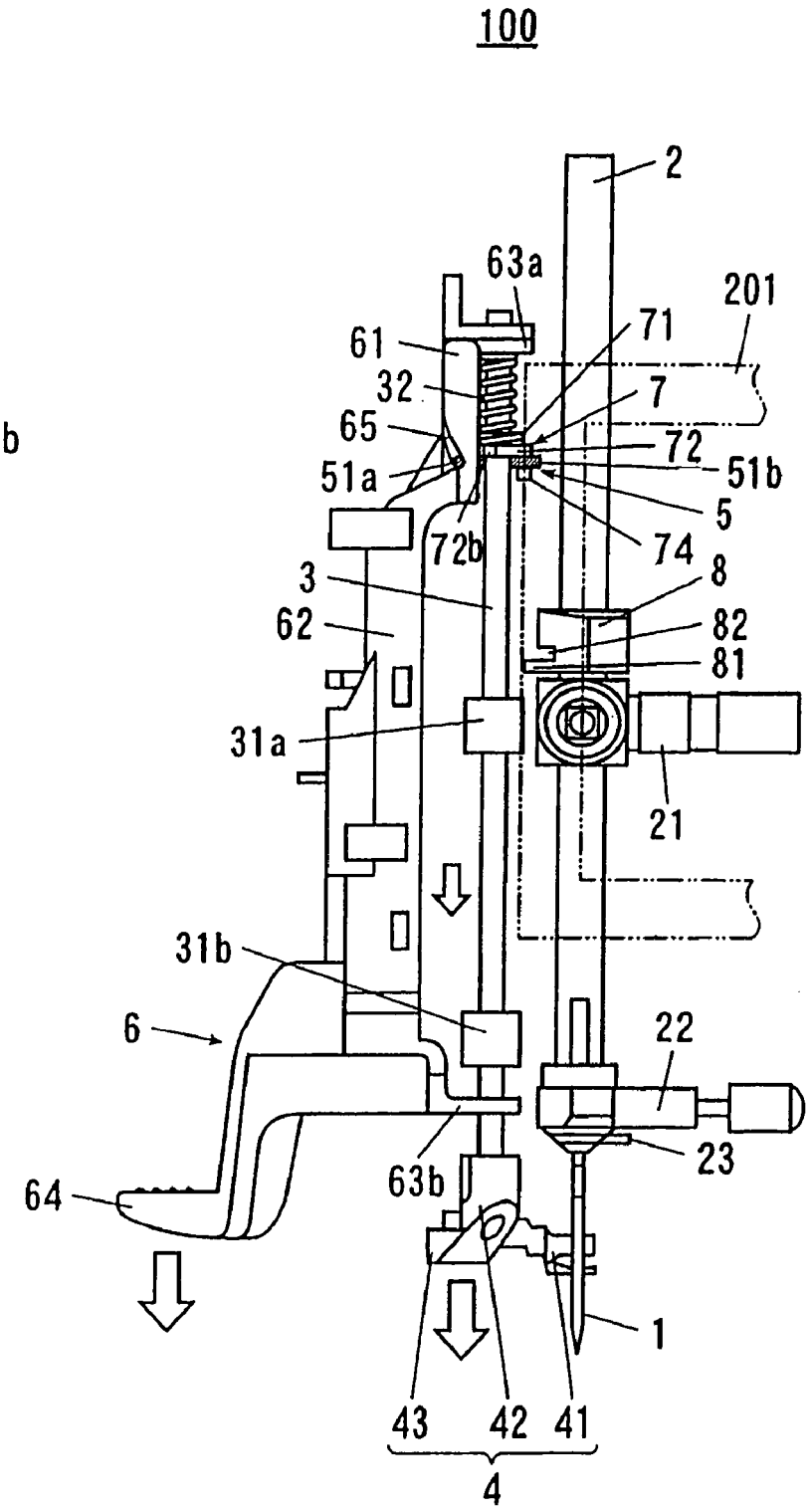
FIG. 2A is a front view showing the threading device for a sewing machine according to the embodiment of the invention, illustrating a state brought before a threading lever is pushed downward.
Figure 3:
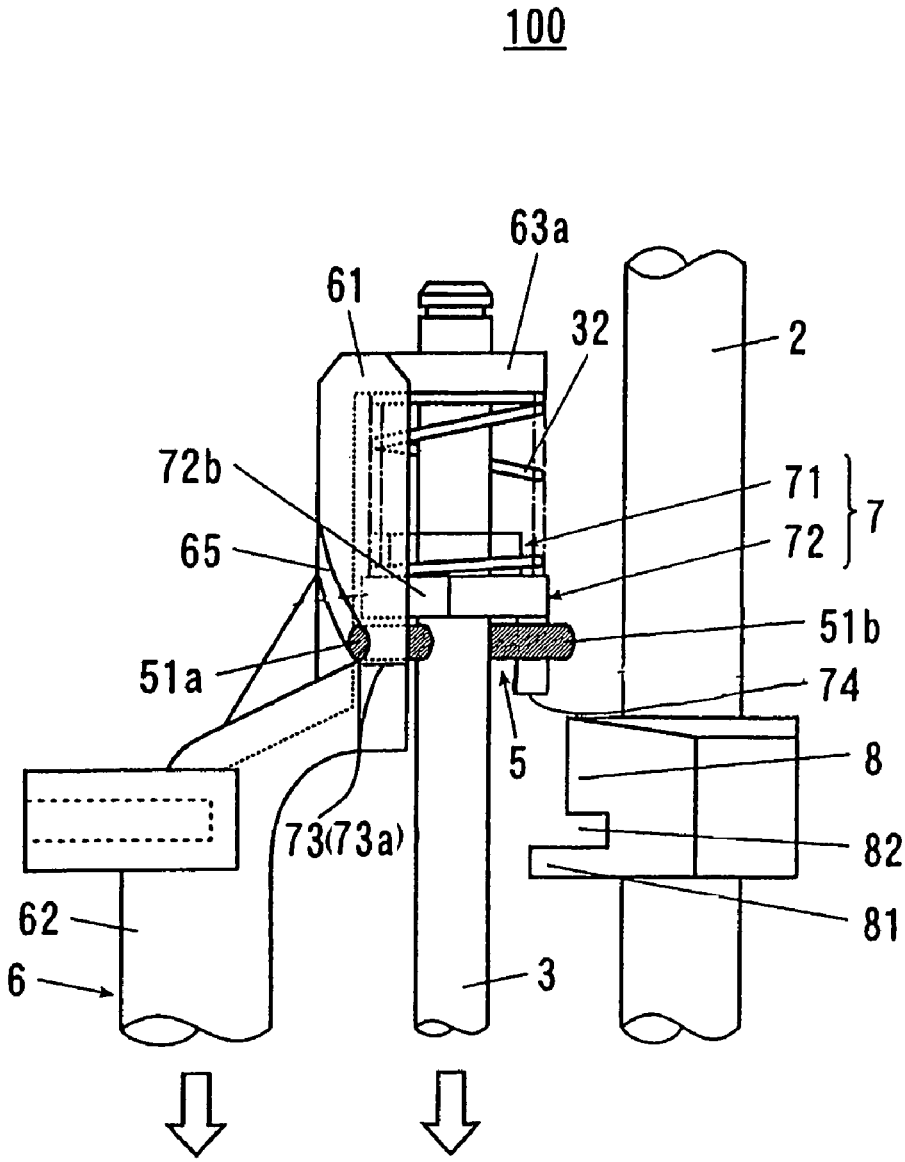
FIG. 3 is an enlarged view showing the upper end of the threading device for a sewing machine in FIGS. 2A and 2B.

As shown in FIGS. 2A, 2B and 3, the threading device 100 comprises a threading shaft 3 disposed in almost parallel with the needle bar 2, a threading member 4 provided on a lower end of the threading shaft 3, a pin 5 having both ends protruded in a radial direction in an upper part of the threading shaft 3, a threading lever (operation means) 6 which can be vertically moved by an operator, an erroneous rotation preventing member 7 provided on the threading shaft 3 above the pin 5, and a threading shaft guide 8 provided in a middle part of the needle bar 2.

The threading member 4 is constituted by a threading hook 41 to be a hook-shaped click which is moved forward and backward into an eye of the needle 1 and pulls the thread into the eye by the rotation of the threading shaft 3, a hook holder 42 to be fixed to the lower end of the threading shaft 3, and a guide plate 43 for sliding and guiding the thread. The threading hook 41 and the guide plate 43 have the same structures as those in the conventional art in which they are positioned on opposite sides to each other with respect to the threading shaft 3. When the threading hook 41 is disposed in such a position as to enter the needle eye from a back face, the thread is laid over the guide plate 43 and is thus held in a preparation state which is suitable for catching the thread on the threading hook 41.

Each member will be described below.

A needle bar holder 21 to be reciprocated in a vertical direction through a crank from a main shaft (not shown) is fixed to a middle portion on an upper side of the needle bar 2. The threading shaft guide 8 is fixed to the needle bar 2 just above the needle bar holder 21.

Furthermore, a needle stopper 22 for fixing the needle 1 is attached to the lower end portion of the needle bar 2 and a thread guide 23 on which the thread is hung is screwed into the needle stopper 22.

The threading shaft 3 is inserted and supported rotatably and movably in a vertical direction in bearings 31*a* and 31*b* provided in the arm portion 201 in almost parallel with the needle bar 2.

Moreover, the pin 5 penetrating through the threading shaft 3 has a first protruded portion 51*a* protruded toward the threading lever 6 side and a second protruded portion 51*b* protruded toward the needle bar side.

The threading lever 6 is extended vertically in almost parallel with the threading shaft 3 and upper and lower ends thereof are extended in a horizontal direction so that inserting portions 63*a* and 63*b* are provided. The threading shaft 3 is inserted through the inserting portions 63*a* and 63*b* so as to be vertically movable and rotatable.

The threading lever 6 is integrally provided with an upper elongated portion 61 formed like a circular arc which is opposed to the upper end of the threading shaft 3, a lower elongated portion 62 which is extended downward from the upper elongated portion 61, and a lever portion 64 which is provided on a lower end so as to be freely pushed downward with fingers of an operator. A spiral guide groove 65 with the threading shaft 3 to be an axial center is formed in the upper elongated portion 61.

A shaft spring (energizing means) 32 through which the threading shaft 3 is inserted is positioned on a lower surface of the upper inserting portion 63*a*, and the erroneous rotation preventing member 7 for preventing the erroneous rotation of the threading shaft 3 in engagement of the second protruded portion 51*b* of the pin 5 is positioned on a lower end of the shaft spring 32.

The shaft spring 32 energizes the upper inserting portion 61 of the threading lever 6 and the erroneous rotation preventing member 7 in such a direction as to separate them from each other. More specifically, the threading lever 6 can push down the threading shaft 3 of which downward movement is stopped as will be described below against the energizing force of the shaft spring 32.

Moreover, the upper elongated portion 61 is formed like an almost circular arc seen on a plane. The guide groove 65 is formed on an outer peripheral surface of the upper elongated portion 61 spirally along the outer peripheral surface and around the threading shaft 3.

Figure 4B:
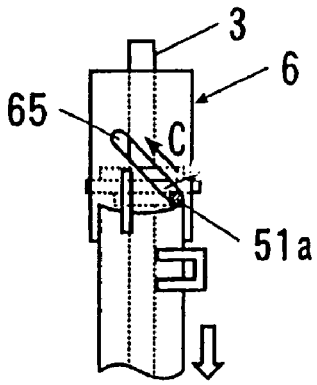
FIG. 4B is a left side view showing the upper end of the threading device for a sewing machine illustrated in FIG. 4A.

The guide groove 65 is formed to be rightward and downward in FIGS. 2B and 4B, that is, in such a manner that a clockwise direction is set to be a downward direction with the threading mechanism seen on a plane. The first protruded portion 51*a* of the pin 5 is slidably inserted in the guide groove 65.

The threading shaft guide (guide member) 8 includes a stopper portion 81 having an upper plane protruded on a vertical moving path of the erroneous rotation preventing member 7 and the second protruded portion 51*b* of the pin 5, the upper plane facing the erroneous rotation preventing member 7 and the second protruded portion 51*b*, and a clearance groove 82 formed seamlessly with respect to the upper plane of the stopper portion 81 and cut substantially in a rectangular shape. The clearance groove 82 can cause the second protruded portion 51*b* of the pin 5 to be consecutively moved into the clearance groove 82 when the second protruded portion 51*b* is engaged with the upper plane of the stopper portion 81.

Next, description will be given to the erroneous rotation preventing member 7 to be a characteristic part of the invention.

Figure 9:
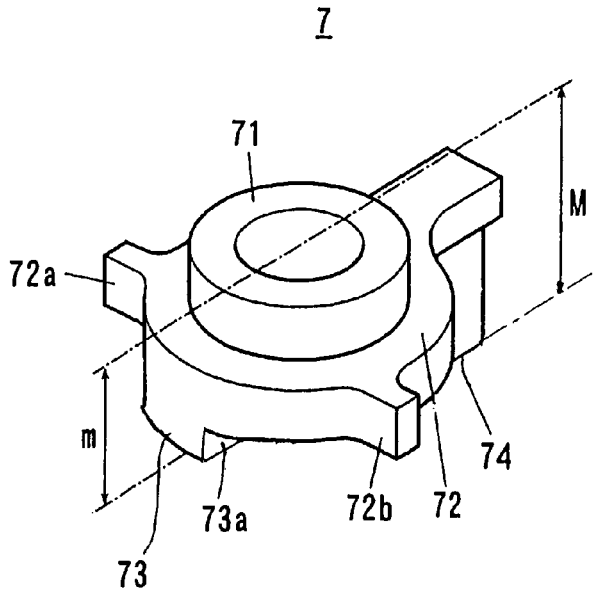
FIG. 9 is a perspective view showing an erroneous rotation preventing member.

The erroneous rotation preventing member 7 is inserted through and supported on the threading shaft 3 between the shaft spring 32 and the pin 5 and always has a lower end engaged with the pin 5. As shown in FIG. 9, the erroneous rotation preventing member 7 includes an upper cylindrical portion 71 taking an almost cylindrical shape through which the threading shaft 3 is to be inserted, and a lower cylindrical portion 72 formed integrally with a lower surface of the upper cylindrical portion 71 and having a larger diameter than the upper cylindrical portion 71.

The lower end of the shaft spring 32 is wound around the outer peripheral surface of the upper cylindrical portion 71 and is engaged with an upper surface of the lower cylindrical portion 72. When the operation lever 6 is pushed downward, the shaft spring 32 positioned between the inserting portion 63*a* of the operation lever 6 and the erroneous rotation preventing member 7 energizes the erroneous rotation preventing member 7 downward.

Two outward projections 72*a* and 72*b* are protruded symmetrically in a lateral direction from the outer peripheral surface of the lower cylindrical portion 72, and abut on a front end and a rear end in the upper elongated portion 61 of the threading lever 6 respectively as shown in FIG. 3 so that the rotation of the erroneous rotation preventing member 7 is regulated with respect to the threading shaft 3.

Furthermore, there is provided a rotation regulating portion 73 protruded downward from the lower surface of the lower cylindrical portion 72 and one of side surfaces of the rotation regulating portion 73 is set to be a regulating surface 73*a*.

Figure 10:
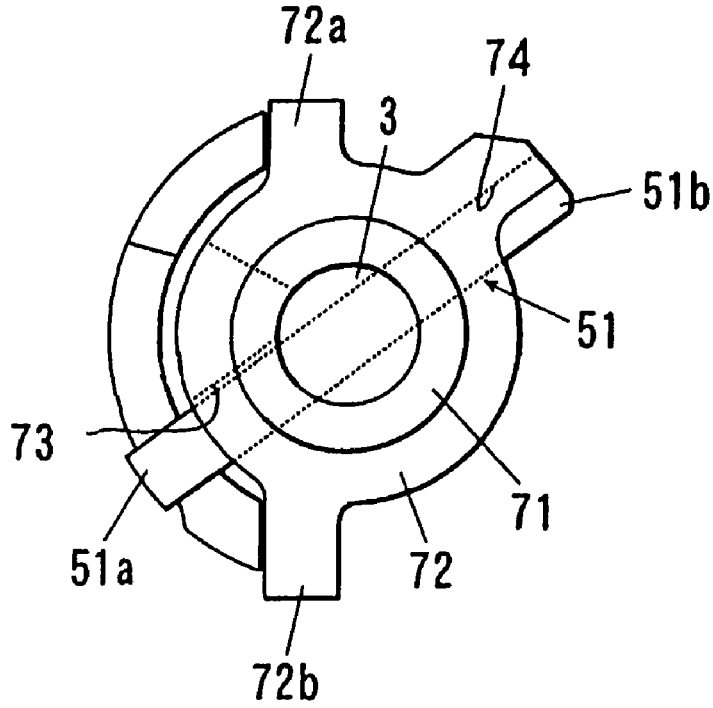
FIG. 10 is an upper sectional view showing a state in which a rotation of a pin is regulated by the erroneous rotation preventing member.
Figure 11B:
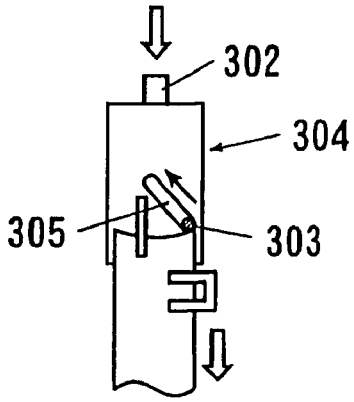
Fig.11B PRIOR ART
FIG. 11B is a left side view showing an upper end of the threading device for a sewing machine illustrated in FIG. 11A.
Figure 11A:
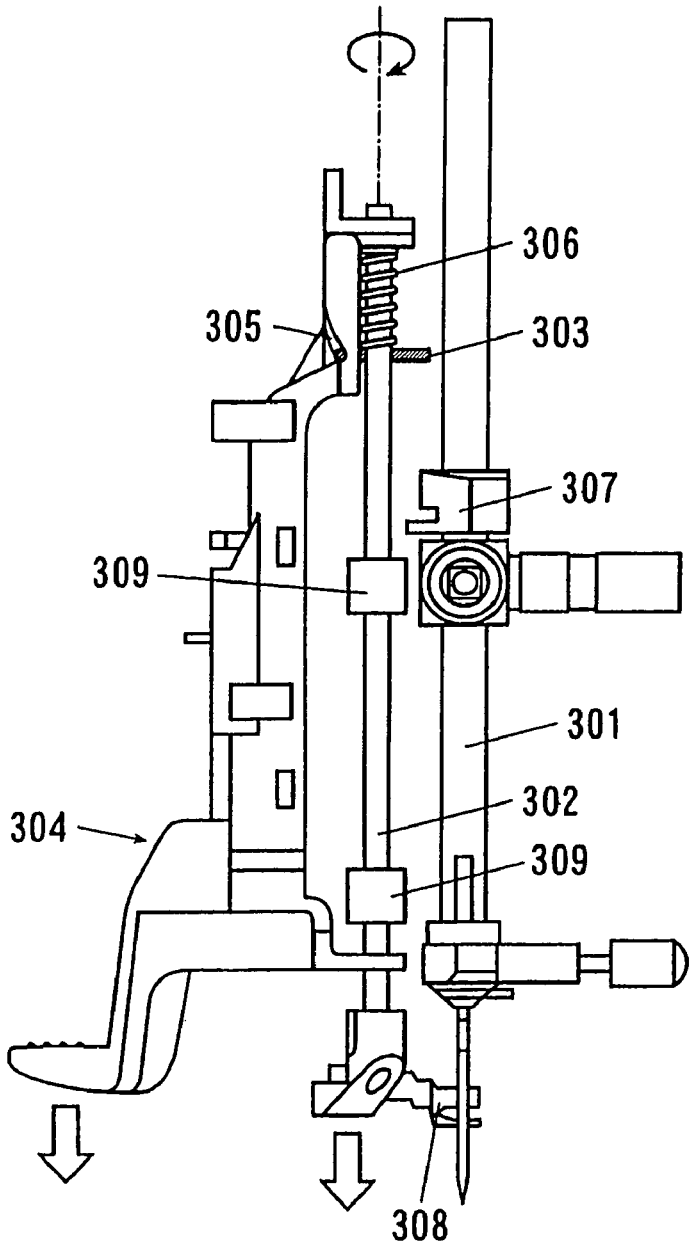
Fig.11A PRIOR ART
FIG. 11A is a front view showing a threading device for a sewing machine according to the conventional example, illustrating a state brought before a threading lever is pushed downward.
Figure 12B:
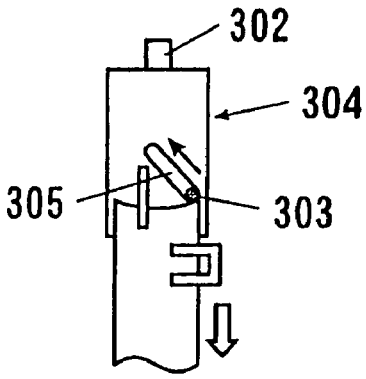
Fig.12B PRIOR ART
FIG. 12B is a left side view showing the upper end of the threading device for a sewing machine illustrated in FIG. 12A.
Figure 12A:
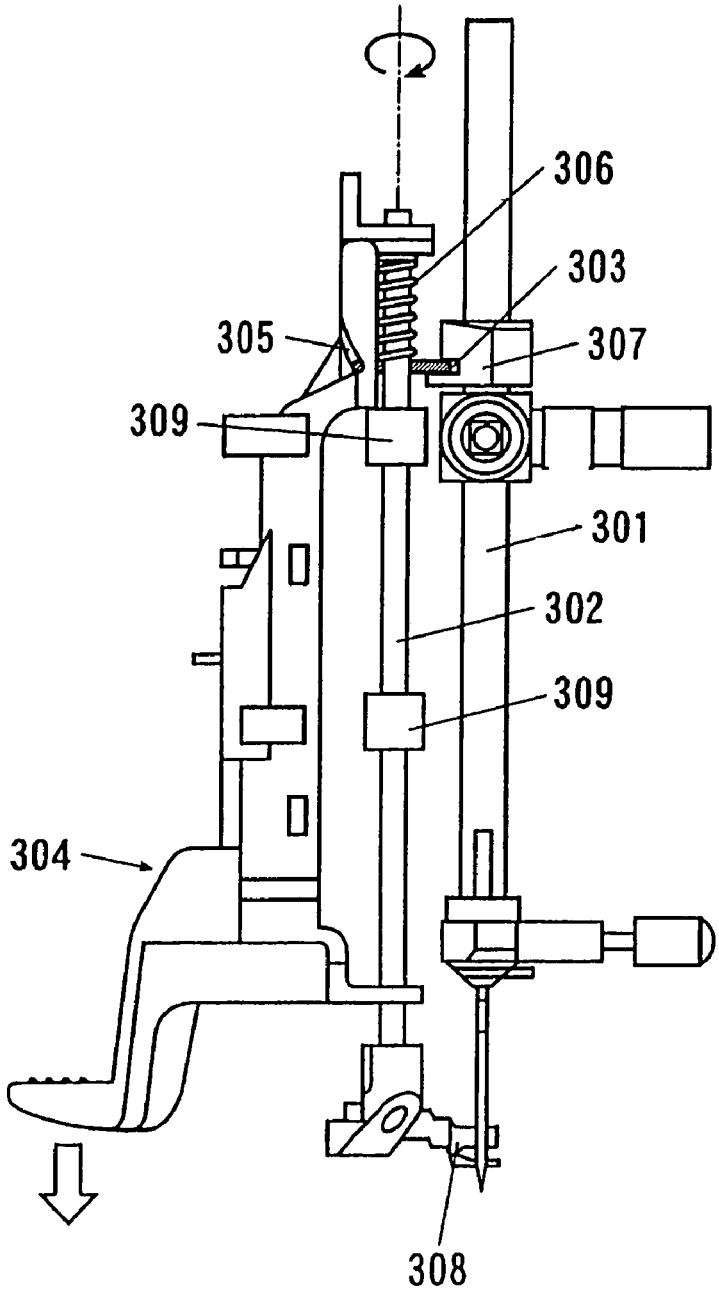
Fig.12A PRIOR ART
FIG. 12A is a front view showing the threading device for a sewing machine according to the conventional example, illustrating a state in which a threading shaft is pushed downward together with the threading lever until a disengaging portion is engaged with a stopper.
Figure 13B:
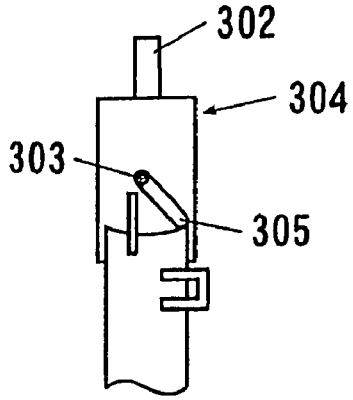
Fig.13B PRIOR ART
FIG. 13B is a left side view showing the upper end of the threading device for a sewing machine illustrated in FIG. 13A.
Figure 13A:
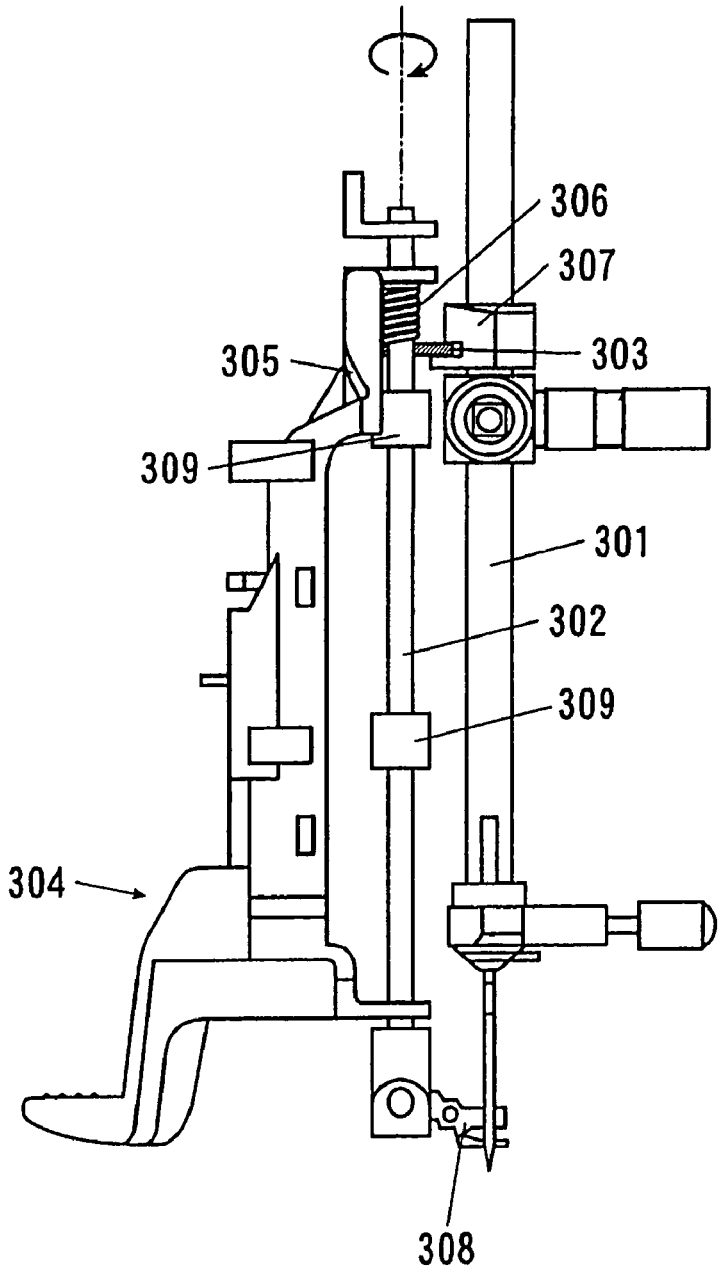
Fig.13A PRIOR ART
FIG. 13A is a front view showing the threading device for a sewing machine according to the conventional example, illustrating a state in which only the threading lever is further pushed downward in the state of FIG. 12A.

The rotation regulating portion 73 has the regulating surface 73*a* opposed to an extension side of the guide groove 65 with respect to the first protruded portion 51*a* of the pin 5 in a state brought before the threading lever 6 is pushed downward as shown in FIGS. 3 and 10. Consequently, the first protruded portion 51*a* is engaged with the regulating surface 73*a* and the pin 5 cannot be moved freely in the guide groove 65. Therefore, it is possible to prevent the rotation of the threading shaft 3 in the direction of the extension of the guide groove 65.

As shown in FIG. 9, moreover, a disengaging portion 74 protruded outward in a radial direction from the lower cylindrical portion 72 and protruded downward is provided to be opposed to the upper part of the stopper portion 81 on the opposite side of the rotation regulating portion A downward extension length M of the disengaging portion 74 is greater than a downward extension length m of the rotation regulating portion 73. Furthermore, the length M is greater than a diameter of the second protruded portion 51*b* (that is, a diameter of the pin 5). For this reason, when the threading shaft 3 is pushed downward together with the threading lever 6, the lower end of the disengaging portion 74 is engaged with the upper surface of the stopper portion 81 earlier than the second protruded portion 51*b*.

Consequently, the downward movement of the erroneous rotation preventing member 7 is stopped, and the pin 5 and the threading lever 6 are moved downward. For this reason, the second protruded portion 51*b* and the first protruded portion 51*a* are positioned below the rotation regulating portion 74 and the first protruded portion 51*a* and the rotation regulating portion 73 are disengaged from each other, and furthermore, the second protruded portion 51*b* is engaged with the stopper portion 81. Therefore, the first protruded portion 51*a* can be moved freely along the guide groove 65, and furthermore, the downward movement of the threading shaft 3 is stopped.

Next, description will be given to the operation of the threading device 100 having the structure described above.

Figure 6:
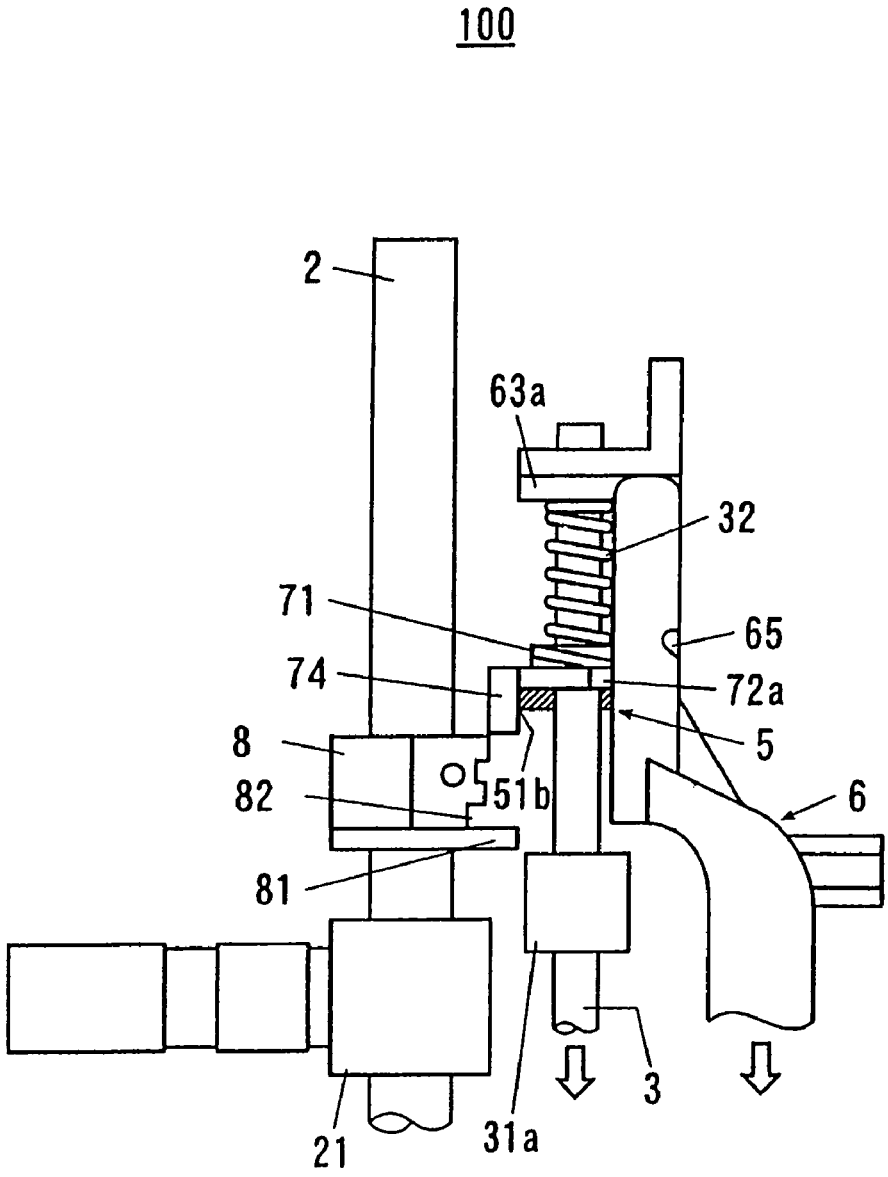
FIG. 6 is a back view showing the upper end of the threading device for a sewing machine illustrated in FIG. 2A.

In an initial state, the first protruded portion 51*a* inserted in the guide groove 65 is opposed to the rotation regulating portion 73 of the erroneous rotation preventing member 7 as shown in FIGS. 2 and 3. Therefore, the first protruded portion 51*a* is engaged with the regulating surface 73*a* of the rotation regulating portion 73 so that the pin 5 can be prevented from being moved along the groove in a lowermost end position of the guide groove 65. Consequently, the rotation of the threading shaft 3 is not permitted but can be moved downward integrally with the threading lever 6. The second protruded portion 51*b* is engaged with a side surface of the disengaging portion 74 as shown in FIG. 6, and a rotation of the threading shaft 3 in both directions is prevented by an engagement with the regulating surface 73*a*.

Figure 4A:
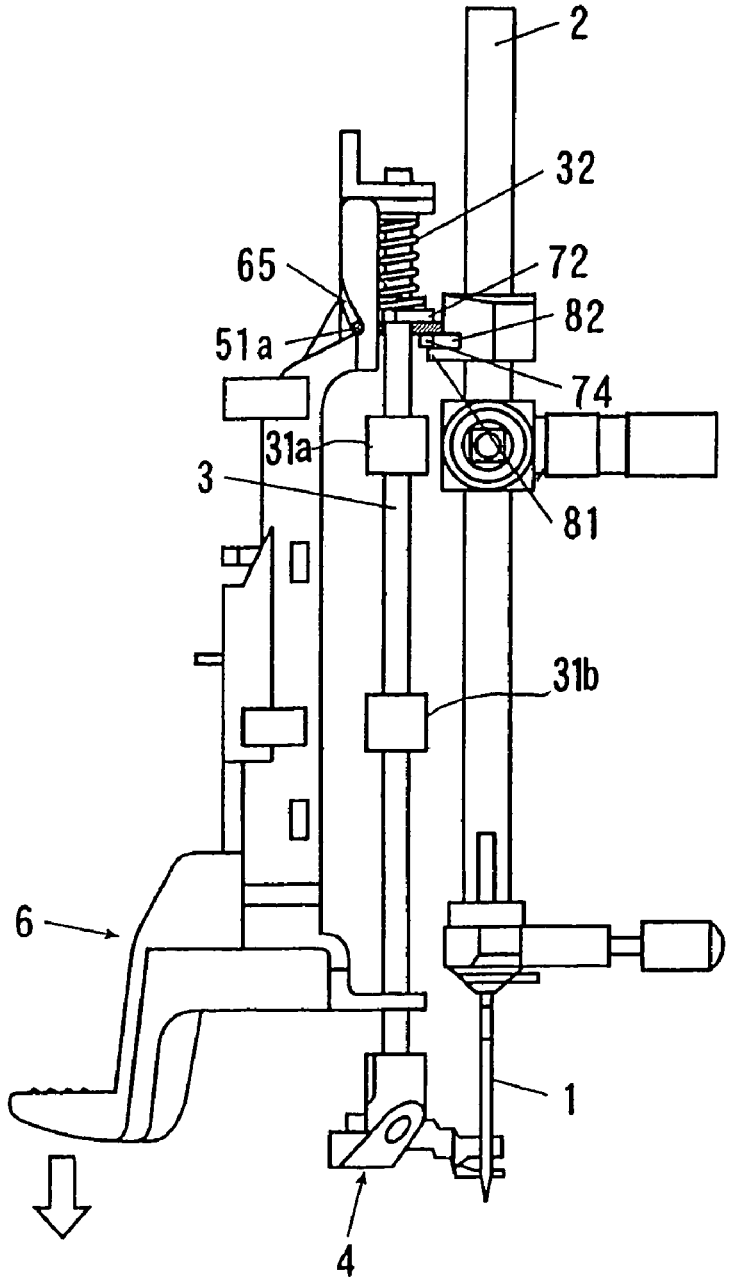
FIG. 4A is a front view showing the threading device for a sewing machine according to the embodiment of the invention, illustrating a state in which a threading shaft is pushed downward together with the threading lever until a disengaging portion is engaged with a stopper.
Figure 7:
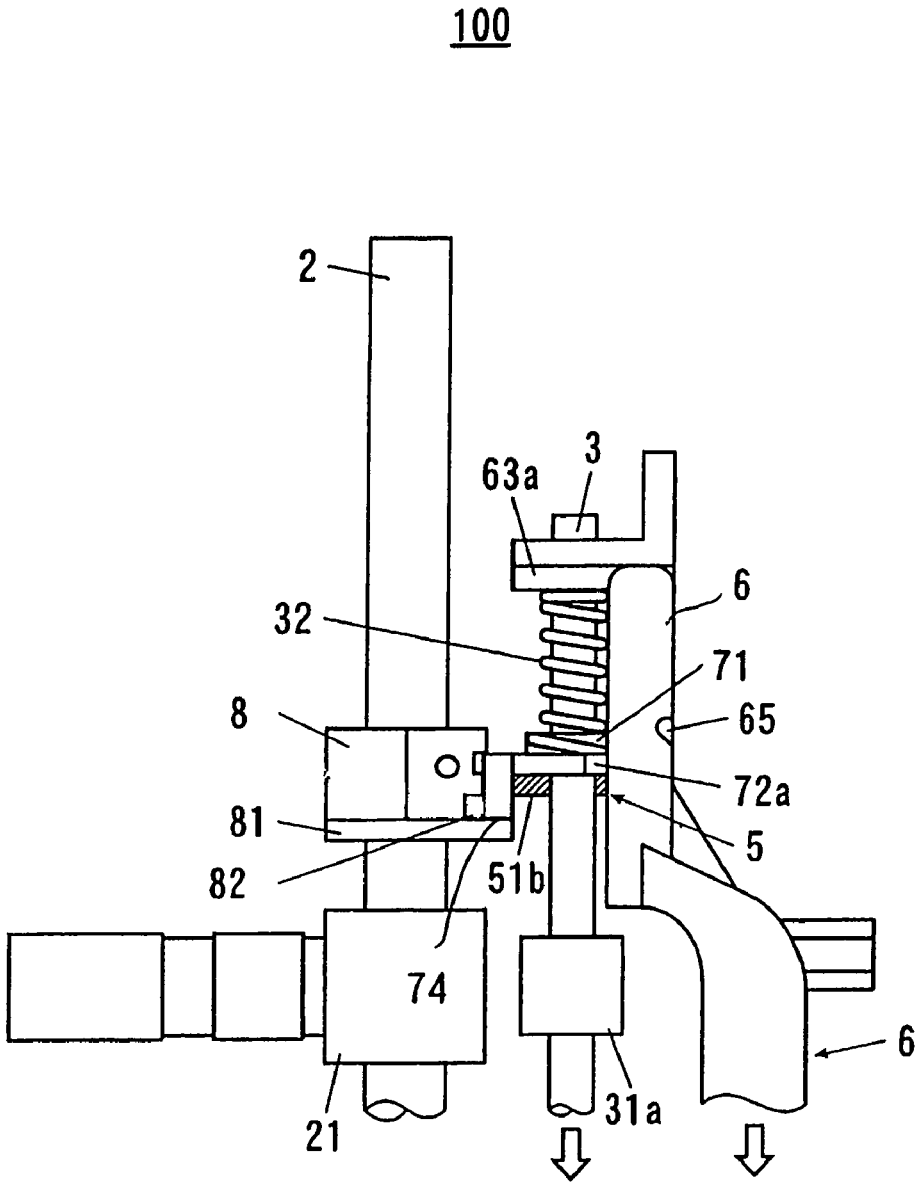
FIG. 7 is a back view showing the upper end of the threading device for a sewing machine illustrated in FIG. 4A.

When the lever portion 64 of the threading lever 6 is pushed downward with fingers in this state, the threading shaft 3 is pushed downward integrally with the threading lever 6. When they are thus pushed downward, the lower end of the disengaging portion 74 of the erroneous rotation preventing member 7 is engaged with the upper surface of the stopper portion 81 of the needle bar guide 8 as shown in FIGS. 4A, 4B and 7.

Consequently, the downward movement of the erroneous rotation preventing member 7 is stopped. However, the pin 5 and the threading lever 6 can be freely moved downward. When the threading lever 6 is further pushed down against the energizing force of the shaft spring 32, the first protruded portion 51*a* is moved downward from the lower end of the rotation regulating portion 73 so that the disengagement from the regulating surface 73*a* is carried out. When the threading lever 6 is further pushed down, the second protruded portion 51*b* of the pin 5 is engaged with the upper surface of the stopper portion 81. Consequently, the first protruded portion 51*a* of the pin 5 can be moved freely along the guide groove 65, and furthermore, the downward movement of the threading shaft 3 is stopped.

However, the threading lever 6 can be freely moved further downward in this state. Therefore, the threading lever 6 is pushed downward with respect to the threading shaft 3. Consequently, the first protruded portion 51*a* is moved relatively upward along the guide groove 65 (a direction of an arrow C) and is moved up to an uppermost end position of the guide groove 65 (see FIGS. 5A, 5B and 8).

When the first protruded portion 51*a* is moved to the uppermost end position of the guide groove 65, the threading shaft 3 is also rotated clockwise.

With the rotation of the threading shaft 3, the threading hook 41 attached to the lower end of the threading shaft 3 is rotated in a position which is on almost the same level as the needle eye of the needle 1, and enters the needle eye of the needle 1 and catches the thread laid over the guide plate 43.

Figure 5B:
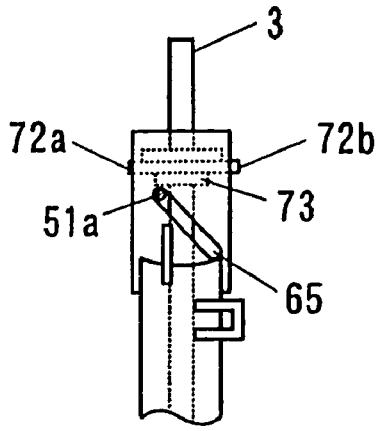
FIG. 5B is a left side view showing the upper end of the threading device for a sewing machine illustrated in FIG. 5A.
Figure 5A:
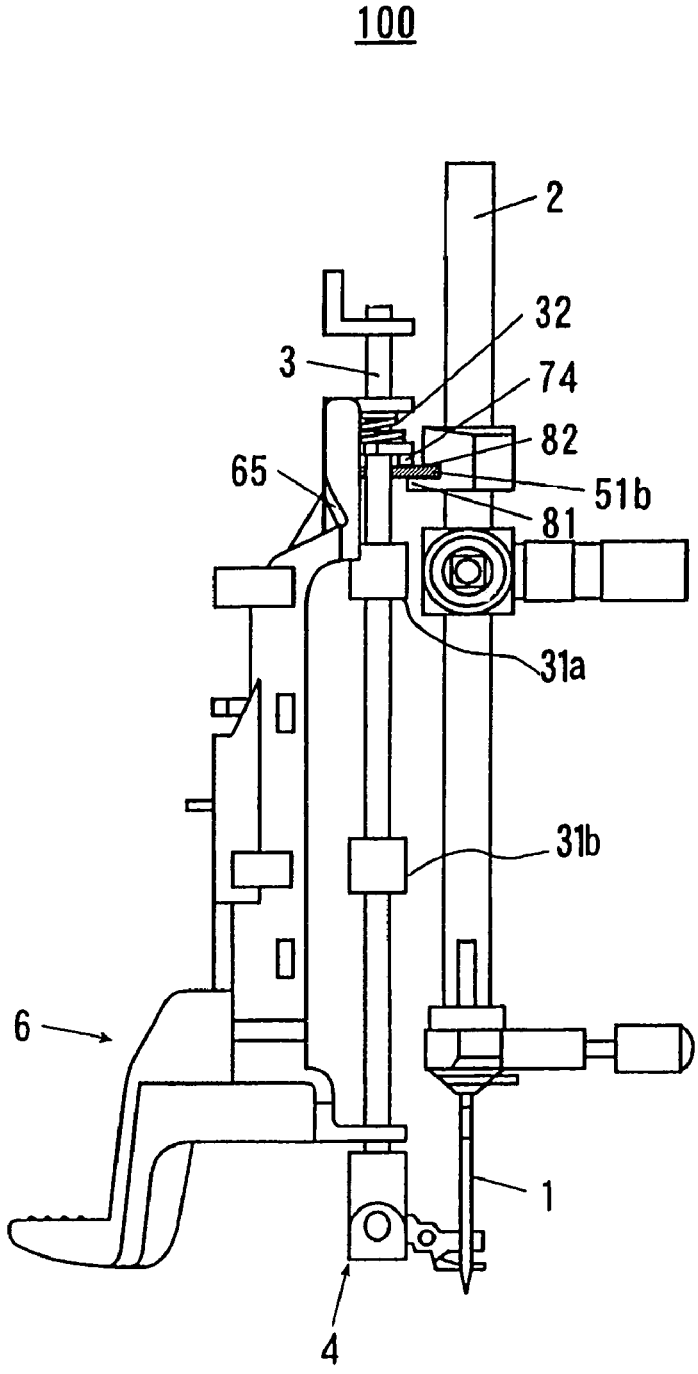
FIG. 5A is a front view showing the threading device for a sewing machine according to the embodiment of the invention, illustrating a state in which only the threading lever is further pushed downward in the state of FIG. 4A.
Figure 8:
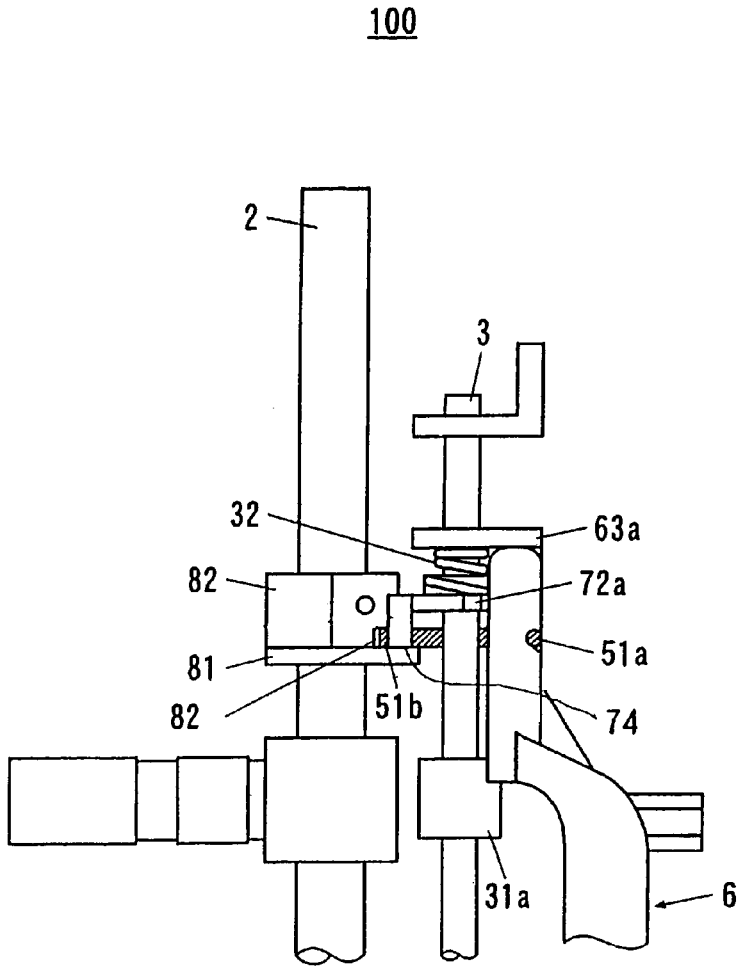
FIG. 8 is a back view showing the upper end of the threading device for a sewing machine illustrated in FIG. 5A.

When a pressing force against the operation lever 6 is gradually released in the state of FIGS. 5A, 5B and 8, subsequently, the operation lever 6 is first pushed upward by the energizing force of the shaft spring 32 so that the first protruded portion 51*a* stopped in the uppermost end position of the guide groove 65 is moved downward in the guide groove 65. Correspondingly, the threading shaft 3 is rotated in a counterclockwise direction and the second protruded portion 51*b* is moved to slip out of the clearance groove 82. When the first protruded portion 51*a* is moved to the lowermost end position of the guide groove 65 as shown in FIGS. 4A, 4B and 7, then, it is engaged by a rotation regulating portion 75 provided on the upper end side of the guide groove 65 in a circumferential direction from the first protruded portion 51*a* and is fixed in the lowermost end position of the guide groove 65 so that the rotation of the pin 5 is prevented again. At this time, the threading shaft 3 is rotated counterclockwise with the rotation of the pin 5.

With the rotation of the threading shaft 3, furthermore, the threading hook 41 entering the needle eye of the needle 1 is returned from the needle eye of the needle 1 to a retracting position. At this time, the thread which is laid over is pulled out of the needle eye of the needle 1. Therefore, the thread is inserted through the needle eye of the needle 1.

When the pressing force against the operation lever 6 is further released, thereafter, the threading shaft 3 and the operation lever 6 are moved integrally and upward by the energizing force of the shaft spring 32 so that the initial state shown in FIGS. 2, 3 and 6 is recovered.

The position of the height of the threading hook 41 is controlled with high precision by the regulation of the second protruded portion 51*b* of the pin 5 into the clearance groove 82 of the threading shaft guide 8.

According to the threading device 100 in accordance with the embodiment of the invention, the rotation regulating portion 73 is provided. Therefore, the first protruded portion 51*a* inserted in the guide groove 65 is engaged with the rotation regulating portion 73 so that the rotation of the pin 5 is prevented.

When the threading lever 6 is moved downward in this state, the erroneous rotation preventing member 7 and the threading shaft 3 are moved downward together with the threading lever 6 and the disengaging portion 74 is engaged with the stopper portion 81 earlier than the pin 5. Consequently, the downward movement of the erroneous rotation preventing member 7 is stopped. However, the pin 5 and the threading lever 6 are moved further downward. Thus, the first protruded portion 51 is moved downward from the rotation regulating portion 74, and the pin 5 and the rotation regulating portion 73 are disengaged from each other, and furthermore, the second protruded portion 51*b* is engaged with the stopper portion 81. Therefore, the first protruded portion 51*a* can be freely moved along the guide groove 65, and furthermore, the downward movement of the threading shaft 3 is stopped. When the threading lever 6 is moved further downward in this state, the pin 5 is moved relatively along the guide groove 65. Therefore, the threading shaft 3 is rotated so that the threading hook 41 is also rotated and the thread is inserted through the needle 1.

Thus, the rotation of the first protruded portion 51*a* of the pin 5 is prevented until the threading lever 6 is moved downward and the disengaging portion 74 is engaged with the stopper portion 81. When the disengaging portion 74 is engaged with the stopper portion 81 so that the first protruded portion 51*a* is disengaged from the rotation regulating portion 73, the first protruded portion 51*a* is moved along the guide groove 65 so that the threading shaft 3 is rotated. Also in the case in which the threading lever 6 is operated on severe conditions, therefore, the threading shaft 3 does not start the rotation in a position other than the normal position but can insert the thread through the needle eye with high precision and the threading hook 41 can be prevented from being bent. Moreover, the erroneous rotation preventing member 7 is provided on the outer peripheral surface of the threading shaft 3. Therefore, a great deal of space is not occupied.

The invention is not restricted to the circumstances but can be properly changed without departing from the scope of the invention.

For example, a type of a sewing machine to which the threading device 100 according to the invention is to be attached is not particularly restricted.

In the embodiment, moreover, "clockwise" seen from above may be replaced with "counterclockwise" and the "counterclockwise" maybe replaced with the "clockwise".

While there has been described in connection with the exemplary embodiment of the present invention, it will be obvious to those skilled in the art that various changes and modification may be made therein without departing from the present invention. It is aimed, therefore, to cover in the appended claim all such changes and modifications as fall within the true spirit and scope of the present invention.

What is claimed is:

1. A threading device for a sewing machine comprising:

a threading shaft disposed in parallel with a needle bar having a needle provided at a lower end thereof, and supported rotatably and movably in a vertical direction with respect to a machine frame;

a threading member provided at a lower end of the threading shaft, and having a threading hook capable of being inserted through a needle eye of the needle;

a pin fixed to the threading shaft, and having both ends protruded outward in a radial direction with respect to the threading shaft;

operation means having a guide groove formed in a spiral shape with respect to a rotating axis of the threading shaft, and capable of being operated in a vertical direction, one end of the pin being inserted through the guide groove; and a guide member having a stopper portion disposed on a vertical moving path of the other end of the pin, and a clearance groove formed seamlessly with respect to the stopper portion, and fixed to the needle bar, wherein the threading device for a sewing machine further comprises an erroneous rotation preventing member provided on the threading shaft, the erroneous rotation preventing member having a disengaging portion capable of being engaged with the stopper portion and a rotation regulating portion capable of being engaged with the pin, further wherein the other end of the pin engages with the stopper portion when the threading shaft moves downward by operating the operation means to move downward, the threading shaft rotates along the guide groove so that the threading member penetrates through the needle eye of the needle when the threading shaft further moves downward, the disengaging portion engages with the stopper portion before the other end of the pin engages with the stopper portion in the downward movement of the threading shaft, and the rotation regulating portion engages with the pin to prevent the rotation of the threading shaft until at least the threading shaft further moves downward after the disengaging portion engages with the stopper portion.

2. The threading device for a sewing machine according to claim 1, wherein the rotation regulating portion has a side surface disposed opposite to the other end of the pin on a side where the threading shaft rotates along the guide groove, and the disengaging portion is protruded downward by at least a vertical length of the pin from a lower end the side surface of the rotation regulating portion.

3. The threading device for a sewing machine according to claim 1, wherein the erroneous rotation preventing member includes a pair of projections to be engaged with the operation means so as not to be rotated with respect to the operation means.

4. A threading device for a sewing machine comprising:

a threading shaft disposed in parallel with a needle bar having a needle provided at a lower end thereof, and supported rotatably and movably in a vertical direction with respect to a machine frame;

a threading member provided at a lower end of the threading shaft, and having a threading hook capable of being inserted through a needle eye of the needle;

a pin fixed to the threading shaft, and having both ends protruded outward in a radial direction with respect to the threading shaft;

operation means having a guide groove formed in a spiral shape with respect to a rotating axis of the threading shaft, and supporting the threading shaft rotatably and movably in a vertical direction; and a guide member having a stopper portion disposed on a vertical moving path of the other end of the pin, and a clearance groove formed seamlessly with respect to the stopper portion, and fixed to the needle bar, wherein the threading device for a sewing machine further comprises erroneous rotation preventing means, further wherein the other end of the pin engages with the stopper portion when the threading shaft moves downward by operating the operation means to move downward, the threading shaft rotates along the guide groove so that the threading member penetrates through the needle eye of the needle when the threading shaft further moves downward, and the erroneous rotation preventing means prevents the threading shaft from rotating in the downward movement of the threading shaft, and permits the threading shaft to rotate when the other end of the pin engages with the stopper portion.

* * * * *